US008097580B2

(12) United States Patent
Brown et al.

(10) Patent No.: US 8,097,580 B2
(45) **Date of Patent: *Jan. 17, 2012**

(54) LIQUID LAUNDRY TREATMENT COMPOSITION COMPRISING AN ASYMMETRIC DI-HYDROCARBYL QUATERNARY AMMONIUM COMPOUND

(75) Inventors: Jodi Lee Brown, Cincinnati, OH (US); Rajan Keshav Panandiker, West Chester, OH (US); Errol Hoffman Wahl, Cincinnati, OH (US); Bernard William Kluesener, Harrison, OH (US); Mark Robert Sivik, Mason Robert, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 267 days.

This patent is subject to a terminal disclaimer.

(21) Appl. No.: 12/489,705

(22) Filed: Jun. 23, 2009

(65) Prior Publication Data

US 2009/0320212 A1 Dec. 31, 2009

Related U.S. Application Data

(60) Provisional application No. 61/075,892, filed on Jun. 26, 2008.

(51) Int. Cl.
*C11D 1/83* (2006.01)

(52) U.S. Cl. ..... 510/504

(58) Field of Classification Search ..... 510/504
See application file for complete search history.

(56) References Cited

U.S. PATENT DOCUMENTS

| | | | | |
|---|---|---|---|---|
| 4,569,800 | A | 2/1986 | Stanley et al. | |
| 4,929,367 | A * | 5/1990 | Thomas et al. | 8/137 |
| 5,151,223 | A * | 9/1992 | Maaser | 510/325 |
| 5,466,394 | A | 11/1995 | De Buzzaccarini et al. | |
| 5,466,934 | A * | 11/1995 | Adams et al. | 250/307 |
| 5,490,944 | A | 2/1996 | Suazon | |
| 5,856,287 | A * | 1/1999 | Motyka et al. | 510/342 |
| 5,919,751 | A | 7/1999 | Bird et al. | |
| 5,929,024 | A | 7/1999 | Stringer et al. | |
| 6,110,886 | A | 8/2000 | Scepanski et al. | |
| 6,291,421 | B1 | 9/2001 | Jacques et al. | |
| 6,399,799 | B1 | 6/2002 | Pereira et al. | |
| 2004/0142841 | A1 | 7/2004 | de Buzzaccarini et al. | |
| 2004/0192568 | A1 * | 9/2004 | Yates et al. | 510/276 |
| 2005/0020476 | A1 | 1/2005 | Wahl et al. | |
| 2005/0119151 | A1 | 6/2005 | Mayer et al. | |
| 2005/0164905 | A1 * | 7/2005 | Chawla et al. | 510/516 |
| 2007/0105739 | A1 | 5/2007 | Wahl et al. | |
| 2009/0325848 | A1 | 12/2009 | Brown et al. | |

FOREIGN PATENT DOCUMENTS

| | | | |
|---|---|---|---|
| EP | 0 011 333 | A | 5/1980 |
| EP | 11333 | * | 5/1980 |
| WO | WO97/12020 | A | 4/1997 |
| WO | WO 2006/072083 | | 7/2006 |
| WO | WO2006/084060 | A1 | 8/2006 |
| WO | WO2007/065872 | A1 | 6/2007 |
| WO | WO 2008/129026 | | 10/2008 |

OTHER PUBLICATIONS

PCT International Search Report , dated Sep. 18, 2009, 9 pages.
International Search Report and Written Opinion from the International Searching Authority, mailed on Sep. 22, 2009, International Application No. PCT/US2009/048418, 13 pages.
Non-Final Office Action, mailed on Jun. 2, 2011, U.S. Appl. No. 12/489,731, 10 pages.

* cited by examiner

*Primary Examiner* — John Hardee
(74) *Attorney, Agent, or Firm* — Gary J. Foose

(57) ABSTRACT

A laundry treatment composition comprising from about 1 wt. % to about 90 wt. % of an asymmetric di-hydrocarbyl quaternary ammonium compound comprising the structure:

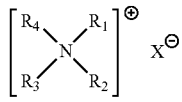

wherein $R_1$ comprises a $C_{12}$ to $C_{22}$ hydrocarbyl chain, wherein $R_2$ comprises a $C_6$ to $C_{12}$ hydrocarbyl chain, which can be branched, wherein $R_1$ has at least two more carbon atoms in the hydrocarbyl chain than $R_2$, wherein $R_3$ and $R_4$ are individually selected from the group consisting of $C_1$-$C_4$ hydrocarbyl, $C_1$-$C_4$ hydroxy hydrocarbyl, benzyl, —$(C_2H_4O)_xH$ where x has a value from about 1 to about 10, and mixtures thereof, and wherein $X^-$ is a anion; and from about 1 wt. % to about 90 wt. % of an anionic surfactant, wherein the laundry treatment composition provides sufficient softness and anti-static benefits without minimized formation of non-soluble flocs.

15 Claims, No Drawings

LIQUID LAUNDRY TREATMENT COMPOSITION COMPRISING AN ASYMMETRIC DI-HYDROCARBYL QUATERNARY AMMONIUM COMPOUND

CROSS REFERENCE TO COPENDING APPLICATIONS

The present application claims priority to copending U.S. Application Ser. No. 61/075,892 to Brown et al, filed Jun. 26, 2008, the disclosure of which is hereby incorporated by reference.

BACKGROUND OF THE INVENTION

Conventional methods of softening fabrics are focused on rinse added fabric softening liquids and dryer added sheets. Conventional fabric softening compounds include cationic quaternary ammonium compounds (cationic "quats") having two symmetrical alkyl or alkenyl chains with an average carbon chain length of from 12 to 18, for example, amido imidazolinium compounds. Examples of attempts to provide softening benefits during the rinsing process are described in: U.S. Pat. No. 5,919,751 to Bird et al., U.S. Pat. No. 5,490,944 to Suazon et al., and U.S. Pat. No. 4,569,800 to Stanley et al.

Softening-through-the-wash compositions (hereinafter "STW" compositions) have become popular as they provide consumers the ability to soften fabrics during the wash, without waiting for the rinse process or the dryer process. Attempts to incorporate conventional cationic quats into STW compositions have encountered problems such as the undesirable formation of water insoluble flocs, also called precipitates. These water insoluble flocs are the result of the ion pairs formed from the conventional cationic quats with the anionic surfactants of the detergent and are known to cause composition opacity and undesirable appearance on the shelf (i.e., phase split). Moreover, these flocs can leave residues on laundered fabrics and cause stains.

Multi-compartment unitized dose pouches have been used to separate the conventional cationic quats from the anionic surfactants. Although the formation of insoluble flocs in the packaged product is minimized, this approach does not resolve the problem of the incompatibility of the quat and anionic surfactant; for example, flocs can still form in the wash bath. Examples of attempts to use multi-compartment unitized dose pouches for STW purposes are mentioned in: U.S. Pat. No. 6,291,421 to Alain et al. and U.S. Pat. No. 6,110,886 to Scepanski et al.; and U.S. Patent Publ. Nos. 2007/0105739 A1 and 2005/0020476 A1, both to Wahl et al.

Recent attempts to address the incompatibility problems with these ingredients involve the use of mono-alkyl quats. While mono-alky quats are less likely to form insoluble flocs in the presence of anionic surfactants, mono-alkyl quats are rather expensive and are believed to be inferior to conventional cationic quats having two alkyl chains, with respect to softening and antistatic benefits. See U.S. Pat. No. 5,466,394 to de Buzzaccarini et al., U.S. Patent Publ. No. 2005/0164905 to Chawla et al., and WO 2006/072083 to Lin et al. Thus there remains an ongoing search for improved STW formulations which provide effective deposition of a fabric conditioning active on the treated fabrics, providing desirable fabric conditioning benefits including but not limited to softening, anti-static, and anti-microbial benefits.

SUMMARY OF THE INVENTION

One aspect of the present invention relates to a laundry treatment composition comprising: from about 1 wt. % to about 90 wt. % of an asymmetric di-hydrocarbyl quaternary ammonium compound comprising the structure:

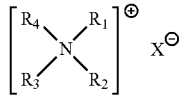

wherein $R_1$ comprises a $C_{12}$ to $C_{22}$ hydrocarbyl chain, wherein $R_2$ comprises a $C_6$ to $C_{12}$ hydrocarbyl chain, wherein $R_1$ has at least two more carbon atoms in the hydrocarbyl chain than $R_2$, wherein $R_3$ and $R_4$ are individually selected from the group consisting of $C_1$-$C_4$ hydrocarbyl, $C_1$-$C_4$ hydroxy hydrocarbyl, benzyl, —$(C_2H_4O)_xH$ where x has a value from about 1 to about 10, and mixtures thereof, and wherein $X^-$ is a anion; and from about 1 wt. % to about 90 wt. % of an anionic surfactant. In one embodiment, the hydrocarbyl chains are alkyl chains. In one embodiment, $R_2$ comprises a branched hydrocarbyl chain.

Another aspect of the present invention relates to a laundry treatment article comprising: a water-soluble film; from about 0.05 grams to about 100 grams of a laundry treatment composition in accordance with at least one embodiment of the present invention, and wherein said laundry treatment composition is encapsulated by said water-soluble film.

Yet another aspect of the present invention relates to a method of softening a fabric through the wash process comprising: dispensing into a wash bath solution from about 0.05 grams to about 100 grams of a laundry treatment composition to form a treated bath solution, said laundry treatment composition being in accordance with at least one embodiment of the present invention and optionally comprising from about 1 wt. % to about 90 wt. % of an anionic surfactant composition; and contacting a fabric with the treated bath solution.

Yet another aspect of the present invention relates to a method of softening a fabric through the rinse process comprising: dispensing into a rinse bath solution from about 0.05 grams to about 100 grams of a laundry treatment composition to form a treated bath solution, said laundry treatment composition being in accordance with at least one embodiment of the present invention, wherein said laundry treatment composition is free or essentially free of a symmetric di-alkyl quat compound; and contacting a fabric with the treated bath solution.

DETAILED DESCRIPTION OF THE INVENTION

The present invention provides a laundry treatment composition which provides sufficient softness, anti-static, and anti-microbial benefits without the water insoluble floc formation problems encountered with conventional cationic quats. It has importantly been found that asymmetric di-hydrocarbyl quaternary ammonium compound (hereinafter "asymmetric di-hydrocarbyl quats") of the present invention are soluble in the presence of anionic surfactants at varying levels.

Importantly, the present laundry treatment composition is suitable for use in a variety of laundry treatment applications (i.e. for STW or conventional rinse cycle softening), and can be used in a single or multi-compartment unit dose in the presence of anionic surfactant. It has been found that laundry treatment compositions in accordance with the present invention do not tend to form the water insoluble flocs encountered with conventional cationic quats, including symmetric di-alkyl quats. Further, the present asymmetric di-hydrocarbyl quats have been found to provide enhanced softening and anti-static benefits compared to the mono-alkyl quats.

Without intending to be bound by theory, it is believed that an ion pair is formed when cationic surfactants are in the presence of anionic surfactant. Conventional cationic quats which are used for laundry applications typically have symmetric alkyl chains of from about 12 to 18 carbon atoms and are believed to be especially susceptible to forming highly insoluble ion pair complexes. Unlike symmetric di-alkyl quats, asymmetric di-hydrocarbyl quats of the present invention avoid forming highly insoluble complexes when in the presence of anionic surfactants. Without intending to be bound by theory, this phenomenon is believed to be due in part to the asymmetric di-hydrocarbyl chains disrupting the crystallinity of the ion pair, making the ion pairs more soluble and less susceptible to forming flocs or phase separating. The desired solubility of the quat can be shown by the ClogP value as disclosed herein.

In one embodiment, the laundry treatment composition is in liquid or gel form. In another embodiment, the laundry treatment composition is in the form of a paste, semi-solid, suspension, powder, or any mixture thereof.

DEFINITIONS

As defined herein, "hydrocarbyl chain" includes saturated and unsaturated hydrocarbyl chains which is any univalent radical derived from a hydrocarbon. Those of skill in the art will understand that hydrocarbyl chains include alkyl and alkenyl chains of varying carbon length for example from 1 carbon to 22 carbons.

As defined here, "asymmetric di-hydrocarbyl quaternary ammonium compounds" or "asymmetric di-hydrocarbyl quats" are di-hydrocarbyl quats with one hydrocarbyl chain being longer than the other hydrocarbyl chain by at least 2 carbons. Conversely, "symmetric di-alkyl quats" are di-alkyl quats wherein both alkyl chains have the same number of carbon atoms or are within 2 carbon atoms.

As defined herein, the term "ClogP" means the logarithm to base 10 of the calculated octanol/water partition coefficient (P). The octanol/water partition coefficient of a composition is the ratio between its equilibrium concentrations in octanol and water. Given that this measure is a ratio of the equilibrium concentration of a composition in a non-polar solvent (octanol) with its concentration in a polar solvent (water), ClogP is also a measure of the hydrophobicity of a material—the higher the ClogP value, the more hydrophobic the material. ClogP values can be readily calculated from a program called "CLOGP" which is available from Daylight Chemical Information Systems Inc., Irvine Calif., USA. Octanol/water partition coefficients are described in U.S. Pat. No. 5,578,563.

As defined herein, "essentially free of a component" means that no amount of that component is deliberately incorporated into the composition.

As defined herein, "homogeneous" means that no visible phase separation is observed under the Shelf Storage Test as defined herein and/or that substantially no flocs are observed under the Floc Formation Test as defined herein.

As defined herein, "unit dose" or "unitized dose" means an amount of the laundry treatment composition suitable to treat one load of laundry, such as from about 0.05 grams to about 100 grams, preferably from 10 grams to about 60 grams, preferably from about 20 grams to about 40 grams.

As defined herein, "soluble" means that the asymmetric di-hydrocarbyl quaternary ammonium compound forms a non-flocculating composition when present in a liquid composition containing from about 1 wt. % to about 90 wt. % of an anionic surfactants.

All measurements are performed at 25° C., unless otherwise specified.

1. Asymmetric Di-Hydrocarbyl Quat

The laundry treatment composition of the present invention comprises from about 1 wt. % to about 90 wt. % of at least one asymmetric di-hydrocarbyl quat. In one embodiment, the laundry treatment composition comprises from about 5 wt. % to about 75 wt. % of said at least one asymmetric di-hydrocarbyl quat, or at least about 8 wt. %, or at least about 10 wt. %, or at least about 15 wt. %, or at least about 30 wt. %, or at least about 50 wt. %.

In one embodiment, the asymmetric di-hydrocarbyl quat has the structure of formula (1):

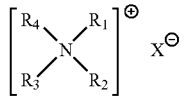

wherein $R_1$ comprises a $C_{12}$ to $C_{22}$ hydrocarbyl chain, wherein $R_2$ comprises a $C_6$ to $C_{12}$ hydrocarbyl chain, wherein $R_1$ has at least two more carbon atoms in the hydrocarbyl chain than $R_2$, wherein $R_3$ and $R_4$ are individually selected from the group consisting of $C_1$-$C_4$ hydrocarbyl, $C_1$-$C_4$ hydroxy hydrocarbyl, benzyl, —$(C_2H_4O)_xH$ where x has a value from about 1 to about 10, alternatively from about 2 to about 5, and mixtures thereof, and wherein $X^-$ is a anion, examples of suitable anions include Br—, Cl—, I—, $OSO_3CH_3$—. In one embodiment, the $R_3$ and $R_4$ are individually selected from the group consisting of $C_1$-$C_4$ hydrocarbyl and $C_1$-$C_4$ hydroxy hydrocarbyl.

In one embodiment, the $R_2$ of the asymmetric di-hydrocarbyl quat comprises a branched hydrocarbyl radical having from about 8 to about 12 carbon atoms. In another embodiment, the branched hydrocarbyl radical of $R_2$ comprises a $C_1$-$C_4$ hydrocarbyl and $C_1$-$C_4$ hydroxy hydrocarbyl branching at the C1, C2, or C3 position along the $R_2$ chain. In yet another embodiment, the asymmetric di-hydrocarbyl quat consists essentially of a hydrogenated tallow 2-ethyl-hexyl-ammonium compound, commercially marketed under the trade name of Arquad® HTL8-MS by Akzo Nobel Co. One example is:

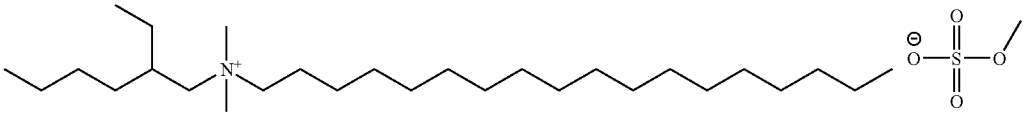

Examples of asymmetric di-hydrocarbyl quats are disclosed in U.S. Pat. No. 4,569,800 to Stanley et al.

In one embodiment, the asymmetric di-hydrocarbyl quat has a ClogP of from about 4 to about 9, alternatively from about 6 to about 8. Hydrogenated tallow 2-ethyl-hexyl-ammonium compound is known to have a ClogP of about 7.5.

Without intending to be bound by theory, it is believed that a ClogP of the present range is comparatively more water soluble than a ClogP above 9 and less water soluble than a ClogP below 4. A ClogP below 4 is too water soluble to form the coacervate as described below. It has been found that the ClogP range of the present invention provides both water solubility capabilities and coacervate forming capabilities desired for suitable fabric conditioning benefits.

Cationic quats have been considered to perform most efficiently for softness and static performance when added in the rinse cycle. Within this class of compounds, cationic quats having ClogP from about 4 to about 9 are believed to be more efficient at providing softness and antistatic benefits when added to the wash and/or rinse cycle. In one embodiment, the asymmetric di-hydrocarbyl quat of the present invention provides the same softness and/or antistatic benefits at a substantially reduced the level as a symmetric di-alkyl quat, such as about 10% less, or about 30% less or up to about 50% less. The asymmetric nature of the di-hydrocarbyl chains, which can be the result of the branching on the $R_2$ chain or the asymmetric nature of the $R_1$ and $R_2$ chains, is believed to contribute to the ability of the asymmetric di-hydrocarbyl quat to interact with the anionic surfactant creating a coacervate complex. In one embodiment, the coacervate is water soluble. It is believed that the formation of the coacervate complex facilitates the deposition of the asymmetric di-hydrocarbyl quat onto fabrics.

In one embodiment, the weight ratio of anionic surfactant to asymmetric di-hydrocarbyl quat is from about 3:1 to about 20:1, alternatively from about 2:1 to about 10:1.

In one embodiment, the present invention is free or essentially free of one or more of a symmetric di-alkyl quat, a mono-akyl quat, an amido imidazoliunium quat, and combinations thereof. In another embodiment, the present invention is free or essentially free of any cationic surfactant not having a structure of formula (1) as disclosed herein.

2. Anionic Surfactant

In one embodiment, the surfactant component herein includes from about 1 wt. % to about 90 wt. %, alternatively from about 5% to about 50%, alternatively from about 10% to about 40%, by weight of the detergent composition, of an anionic surfactant.

In one embodiment, the anionic surfactant comprises a $C_{11}$-$C_{18}$ alkyl benzene sulfonate surfactant; a $C_{10}$-$C_{20}$ branched-chain and random alkyl sulfate surfactant; a $C_{10}$-$C_{18}$ alkyl alkoxy sulfate surfactant, having an average degree of alkoxylation of from 1 to 30, wherein the alkoxy comprises a $C_1$ to $C_4$ chain and mixtures thereof; a mid-chain branched alkyl sulfate surfactant; a mid-chain branched alkyl alkoxy sulfate surfactant having an average degree of alkoxylation of from 1 to 30, wherein the alkoxy comprises a $C_1$ to $C_4$ chain and mixtures thereof; a $C_{10}$-$C_{18}$ alkyl alkoxy carboxylates comprising an average degree of alkoxylation of from 1 to 5; a $C_{12}$-$C_{20}$ methyl ester sulfonate surfactant, a $C_{10}$-$C_{18}$ alpha-olefin sulfonate surfactant, a $C_6$-$C_{20}$ sulfosuccinate surfactant, and a mixture thereof.

Suitable anionic surfactants for use herein include alkyl polyethoxylate sulfates, and may contain other non-soap anionic surfactants, or mixtures thereof. In one embodiment, the anionic surfactant comprises less than about 6 wt. % of an alkyl benzene sulfonate.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_{8-18}$ carbon atoms) such as those produced by reducing the glycerides of tallow or coconut oil.

Other anionic surfactants herein are the water-soluble salts of: paraffin sulfonates containing from about 8 to about 24 (alternatively about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

The anionic surfactant can comprise analkyl polyethoxylate sulfates of the formula:

$$RO(C_2H_4O)_xSO_3^-M^+$$

wherein R is an alkyl chain having from about 10 to about 22 carbon atoms, saturated or unsaturated, and the longest linear portion of the alkyl chain is 15 carbon atoms or less on the average, M is a cation which makes the compound water-soluble, especially an alkali metal, ammonium or substituted ammonium cation, and x is from 1 to about 15. In one embodiment, the surfactant component of the present compositions comprises from about 60 wt. % to about 100 wt. %, of the surfactant component, of an alkyl polyethoxylate sulfate, alternatively at least about 70%, alternatively at least about 80%.

In one embodiment, the anionic surfactant comprises a low level of alkyl benzene sulfonates, for example less than about 6%, alternatively less than about 3%, alternatively less than about 2%. In one embodiment, the laundry treatment composition is free or essentially free of any alkyl benzene sulfonates, such as linear alkyl benzene sulfonates and alkyl benzene sulfonates described in U.S. Pat. No. 5,466,394 at col. 3, line 55-67.

Non-limiting examples of additional anionic surfactants suitable useful herein are disclosed in U.S. Pat. No. 4,285,841 to Barrat et al., and U.S. Pat. No. 3,919,678 to Laughlin, et al.

In one embodiment, the laundry treatment composition further comprises a nonionic surfactant. The compositions of the present invention can contain up to about 30%, alternatively from about 0.01% to about 20%, more alternatively from about 0.1% to about 10%, by weight of the composition, of a nonionic surfactant. In one embodiment, the nonionic surfactant comprises an ethoxylated nonionic surfactant. Examples of suitable non-ionic surfactants are provided in U.S. Pat. No. 4,285,841 to Barrat et al. and U.S. Pat. No.

4,284,532 to Leikhim et al. It is further believed that the addition of a nonionic surfactant to the laundry treatment compositions of the present invention is helpful in providing physical stability to the detergent product, i.e., preventing phase splits and precipitation. This is particularly true for compositions containing levels of asymmetric di-hydrocarbyl quat above about 30 wt %, alternatively above about 50 wt. %, alternatively above about 70 wt. % and/or at levels of anionic surfactant below about 30 wt. %, alternatively below about 15 wt. %, alternatively below about 5 wt. %. In one embodiment, the laundry treatment composition is free or essentially free of nonionic surfactant.

3. Soluble in the Presence of Anionic Surfactant

It has importantly been found that asymmetric di-hydrocarbyl quat are soluble in the presence of anionic surfactant. It is believed that solubility can be measured by the relative % of phase split and floc formation which occurs over time. In one embodiment, the laundry treatment composition has less than 10% phase split, alternatively, less than 5%, alternatively less than 1%, alternatively 0% phase split under the Shelf Storage Test as defined herein. One embodiment of the invention provides for the use of the present laundry treatment composition to soften fabric in the wash and/or rinse bath solutions such that the bath solutions are free or substantially free from flocs.

Shelf Storage Test: Product is stored in a plastic container with lid for 4 weeks at temperatures of 40° F., 70° F., and 100° F. This test is run using a 6 oz container in size. At the 1, 5 and 24 hour intervals, phase stability is assessed by visual observation of any phase split. If the sample has separated into visual layers at any time during the period of testing (total of 4 weeks), these are measured for height, and computed as a percent of the total sample height. The % phase split is calculated as a volume % from the visual measurement of the total sample height at the start of the test and at test intervals. No phase split means no top phase is observed.

Floc Formation Test: 750 grams of a dodecylbenzenesulfonic acid, sodium salt (technical grade, supplied by Aldrich under the catalog number 28,995-7) solution at about 0.02% (using water at 20°-25° C. and 12 US gpg hardness) is added to a 1 liter cylindrical jar (with a diameter to height ratio of approx. 5 to 8). The jar is closed hermetically and shaken vigorously during 15 seconds to generate about 3 cm of foam on top of the solution.

Following this, 5 grams of the composition to be tested is poured on the surface of the foamed solution. The solution in the beaker is then manually stirred for 30 seconds at the rate of 100 rpm (with a 20 cm long, 0.5 cm plastic spatula). One minute after the stirring the solution is poured evenly over the surface of a USA Standard testing sieve (ASTM E11 specification No. 40, 35 mesh Tyler equivalent, opening 425 micron, sieve diameter 8 inch) which has been placed in a collecting tray. The dimensions of this tray are such that at the wires of the sieve are at least 1 cm below the surface of the liquid in the tray once the full 750 grams of test solution has been added. The sieve is subsequently manually lifted out of the tray (kept horizontal) and inspected for the presence of flocs. The test solution is being defined as being "substantially free" from floes if the total number of visible floes retained on the sieve is less than 50. The test solution is being defined as being "free" from flocs if the number of visible flocs retained is less than 10. The filtrate is collected in an identical 1 liter jar.

4. Optional Silicone Polymer

In one embodiment, the laundry treatment composition further comprises a silicone polymer, such as: a polyalkyl silicone, an aminosilicone, a siloxane, a polydimethyl siloxane, an ethoxylated silicone polymer, a propoxylated silicone polymer, an ethoxylated/propoxylated silicone polymer, and mixtures thereof. In one embodiment, the silicone polymer is cationic, such as where the silicone polymer is an amino functional silicone polymer.

Silicone polymers not only provide softness and smoothness to fabrics, but also provide a substantial color appearance benefit to fabrics, especially after multiple laundry washing cycles. While not wishing to be bound by theory, it is believed that silicone polymers provide an anti-abrasion benefit to fabrics in the washing or rinse cycles of an automatic washing machine by reducing friction of the fibers. Suitable polymers for use herein are described in U.S. Patent Publ. No. 2006/0217288 A1 to Wahl et al. at ¶¶11-27.

In one embodiment, the laundry treatment composition is a concentrated composition comprising from about 5% to about 90%, alternatively from about 8% to about 70%, alternatively about 9% to about 30%, alternatively from about 10% to about 25%, alternatively from about 15% to about 24%, of said silicone polymer by weight of the laundry treatment composition. Where the laundry treatment composition is a non-concentrated composition comprising from about 2% to about 30%, alternatively from about 3% to about 20%, alternatively 4% to about 10% of said silicone polymer.

Suitable silicone polymers include any known silicone comprising compound suitable for use in a laundry treatment composition. In one embodiment, the silicone polymer is a polydialkylsilicone, a polydimethyl silicone (i.e. polydimethyl siloxane), or mixtures of derivatives thereof. In another embodiment, the silicone is chosen from an aminofunctional silicone, alkyloxylated silicone, ethoxylated silicone, propoxylated silicone, ethoxylated/propoxylated silicone, quaternary silicone, or combinations thereof. Other useful silicone materials may include materials of the formula:

$$HO[Si(CH_3)_2—O]_x\{Si(OH)[(CH_2)_3—NH—(CH_2)_2—NH_2]O\}_y,H$$

wherein x and y are integers which depend on the mol. weight of the silicone. In one embodiment, the silicone has a viscosity of from about 500 cSt to about 500,000 cSt at 25° C. (also known as "amodimethicone".) In one embodiment, silicone polymer has a high number of amine groups, e.g., greater than about 0.5 millimolar equivalent of amine groups are used. In one embodiment, the laundry treatment composition is free or essentially free of silicone.

5. Optional Deposition Aid

In one embodiment of the present invention, the laundry treatment composition further comprises a deposition aid. In one embodiment, the deposition aid is a cationic polymer, which can interact with the anionic surfactant to form a portion of the coacervate. As defined herein, the optional deposition aid does not include any silicone polymer provided in the composition. While not to be bound by theory, it is believed that the coacervate sweeps up small droplets of the asymmetric di-hydrocarbyl quat, and any other fabric benefit agents such as silicone, in the wash and helps deposit them to the fabric surface. For example, the use of a cationic guar gum and anionic surfactant as a coacervate may effectively increase the deposition efficiency of the asymmetric di-hydrocarbyl quat and/or silicone polymer deposited on the fabrics from an STW composition of the present invention. The coacervate also may help prevent the asymmetric di-hydrocarbyl quat or silicone polymer from being rinsed off the fabrics in the rinse cycle.

The laundry treatment compositions herein can contain from about 0.001% to about 10%, alternatively from about 0.01% to about 5%, alternatively from about 0.1% to about 2%, of deposition aid. In one embodiment, the deposition aid has a molecular weight of from about 500 to about 5,000,000, alternatively from about 1,000 to about 2,000,000, alternatively from about 1,000 to about 1,000,000, and alternatively from about 2,000 to about 500,000. In another embodiment, the deposition aid has a charge density of at least about 0.01 meq/gm., and up to about 23 meq/gm., alternatively from about 0.05 to about 8 meq/gm., alternatively from about 0.08 to about 7 meq/gm., and even alternatively from about 0.1 to about 1 meq/gm.

Suitable deposition aids include amine salts; quaternary ammonium salts; derivatives of natural polymers such as some polysaccharide, gums, starch and certain cationic synthetic polymers such as polymers and copolymers of cationic vinyl pyridine or vinyl pyridinium halides. In one embodiment, the polymers are water-soluble, for instance to the extent of at least 0.5% by weight are soluble in water at 20° C. In another embodiment, the polymers have molecular weights (Daltons) of from about 500 to about 5,000,000, or from about 1,000 to about 2,000,000, or from about 1,000 to about 1,000,000, or from about 2,000 to about 500,000, or from about 2000 to about 100,000. In one embodiment, the cationic polymers have a charge density of at least about 0.01 meq/gm., alternatively from about 0.05 to about 8 meq/gm., alternatively from about 0.08 to about 7 meq/gm., or from about 0.1 to about 1 meq/gm.

In one embodiment, the deposition aid comprises a polysaccharide gum, such as Xanthan Gum; Ghatti Gum; Tamarind Gum; Gum Arabic; and Agar; a cationic guar gum; and a galactomannam gums such as guar and locust bean gums. In another embodiment, the deposition aid comprises a cationic polysaccharide or starch, and derivatives thereof. Suitable cationic starches include natural starches such as those obtained from maize, wheat, barley etc., and from roots such as potato, tapioca etc., and dextrins, particularly the pyrodextrins such as British gum and white dextrin. Cationic starches are described in U.S. Pat. Publ. 2004/0204337 A1.

Suitable cationic polymers for use as deposition aids are disclosed in detail in U.S. Pat. No. 6,492,322 at col. 6, line 65 to col. 24, line 24; U.S. Patent Publs. 2003/0139312 A1 at ¶¶317-47 and 2006/0217288 A1 to Wahl et al., at ¶¶61-84, section entitled "Cationic Polymers"; and in the CTFA "International Cosmetic Ingredient Dictionary and Handbook," Tenth Edition, Tara E. Gottschalck and Gerald N. McEwen, Jr., editors, published by The Cosmetic, Toiletry, and Fragrance Association, 2004. In one embodiment, the laundry treatment composition is free or essentially free of a deposition aid.

6. Coacervate

In one embodiment, a coacervate is formed from the asymmetric di-hydrocarbyl quat with the anionic surfactant. In another embodiment, a portion of the the coacervate is formed from said optional deposition aid. More complex coacervates can also be formed with other charged materials in the laundry treatment composition, i.e., in conjunction with anionic, cationic, zwitterionic and/or amphoteric surfactants or polymers, or mixtures thereof. It is believed that the formation of a coacervate in the composition or in-situ during the wash and/or rinse where the asymmetric di-hydrocarbyl quat comes into contact with anionic surfactant carry over from the wash process assists in the delivery and deposition of the asymmetric di-hydrocarbyl quat onto the fabric.

In one embodiment, the laundry treatment composition comprises from about 0.01 wt. % to about 20 wt. %, alternatively from about 0.1 wt. % to about 10 wt. %, and alternatively from about 0.5 wt. % to about 2 wt. % of a coacervate. These percentages account only for the portion of the coacervate formed from the asymmetric di-hydrocarbyl quat, the deposition aid or combinations thereof, and the anionic surfactant. The percentage does not any water that may or may not be associated with the coacervate. It is surprising that such relatively small amounts of coacervate in the compositions of the present invention may provide such a relatively large increase in the effective deposition to laundry treatment active.

The laundry treatment compositions of the present invention, in one embodiment, involve the formation of a coacervate phase. The phrase "coacervate phase" is used herein in the broadest sense to include all kinds of separated polymer phases known by the person skilled in the laundry treatment art such as disclosed in L. Piculell & B. Lindman, Adv. Colloid Interface Sci., 41 (1992) and in B. Jonsson, B. Lindman, K. Holmberg, & B. Kronberb, "Surfactants and Polymers In Aqueous Solution", John Wiley & Sons, 1998. The mechanism of coacervation and all its specific forms are described in "Interfacial Forces in Aqueous Media", C. J. van Oss, Marcel Dekker, 1994, pages 245 to 271. One skilled in the art will readily appreciate the phrase "coacervate phase," is also often referred to the literature as a "complex coacervate phase" or as "associated phase separation."

Where a coacervate phase is formed, the level of asymmetric di-hydrocarbyl quat and/or the optional deposition aid can range from about 20% to about 80%, alternatively from about 30% to about 80% by weight of the coacervate phase, not including any water that might be associated with the coacervate phase, with the balance being an anionic surfactant. It is believed that the asymmetric di-hydrocarbyl quat and/or the optional deposition aid neutralize the negative charge from the anionic surfactant. In one embodiment, an excess level of anionic surfactant in the composition is provided, and may assist with dispersing the laundry treatment composition in the wash. In one embodiment, the coacervate has a ClogP value below the ClogP value of the di-hydrocarbyl quat and/or deposition aid alone. This is shown by the coacervate formation in the wash as the coacervate is less soluble than the individual components forming the coacervate.

One skilled in the art will readily be able to identify whether a coacervate is formed, and techniques for analysis of formation of coacervates are known in the art. For example, microscopic analyses of the compositions, at any chosen stage of dilution, can be utilized to identify whether a coacervate phase has formed. Such a coacervate phase will be identifiable as an additional dispersed phase in the composition. Texture enhancing microscopy can be used such as phase contrast and Nomarski optics to help identify a coacervate phase. The use of dyes can aid in distinguishing the coacervate phase from other insoluble phases dispersed in the composition. For example, an "Anionic Red Dye Test" may be used as described herein.

Anionic Red Dye Coacervate Identification Test: This procedure can be used to qualitatively identify the presence of the coacervate in a laundry treatment composition. The anionic Direct Red No. 80 dye will prefer to be with the cationic component of the coacervate. The coacervate has a distinct amorphous shape and texture from the rest of the matrix.

Procedure: Combine 0.5 g of 25% active Direct Red No. 80 dye powder (from Sigma-Aldrich) and 19.5 g DI water for a 0.625% dye solution. Add 5 drops of dye solution to 25 g of test product and stir.

Evaluation: Centrifugation: Place 10 mL of dyed product into a 15 mL centrifuge tube and centrifuge for 30 minutes at 10,000 rpm. (for example, use a Beckman Ultima L-70K ultracentrifuge with SW40Ti rotor). If there is no coacervate there will normally only be 2 layers. A top silicone layer and a bottom water/solvent layer that both contain dye. If there is a coacervate, there will be 3 distinct layers. A top whitish silicone layer, a middle layer containing the red dyed coacervate, and a water/solvent layer at the bottom.

Evaluation under microscope: Prepare a slide of dyed product and evaluate under microscope (for example, use an Olympus BH2 microscope, 20× objective, normal light source). If there is no coacervate, the appearance of spherical silicone droplets can be seen with an evenly distributed pink hue from the Direct Red No. 80 dye. The coacervate appears as amorphous or stringy globs that are an intense red color compared to the surrounding matrix.

Evaluation upon dilution: Place 0.5 g of dyed product into a container and dilute with 49.5 g DI water for a 1:100 dilution. If there is no coacervate, the solution appears homogeneous with a uniform red color throughout with few/no particles seen. A coacervate will appear as small particles with an intense red color floating in the clear water solution.

In one embodiment, the coacervate phase is formed prior to introduction into the wash and or rinse process, for example, already built in the finished laundry treatment composition. It is also suitable that the coacervate phase is suspended in a structured matrix. In one embodiment, the coacervate phase may also be formed upon dilution of the composition with a diluent during the laundry treatment application, e.g. during the wash and/or rinse cycles.

In another embodiment, the laundry treatment composition contains an insufficient amount of an anionic surfactant to form a complete coacervate. In this case some or all of the coacervate is formed in the wash cycle by interaction of the laundry treatment composition with any anionic surfactant(s) delivered to wash cycle by the laundry detergent used. In this case, part or all of the coacervate is formed in-situ in the washing cycle of the laundry process.

7. Perfume

In one embodiment, the laundry treatment composition comprises a perfume at a level of at least about 0.001%, or at least about 0.01%, or at least about 0.1%, to about 10%, or to about 5%, or to about 3%, by weight. In one embodiment, the perfume of the fabric conditioning composition of the present invention comprises an enduring perfume ingredients) that have a boiling point of about 250° C. or higher and a ClogP of about 3.0 or higher, or at a level of at least about 25%, by weight of the perfume. Suitable perfumes, perfume ingredients, and perfume carriers are described in U.S. Pat. No. 5,500,138; and U.S. 2002/0035053 A1. In another embodiment, the perfume comprises a perfume microcapsule and/or a perfume nanocapsule. Suitable perfume microcapsules and nanocapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. Pat. No. RE 32,713; U.S. Pat. No. 4,234,627.

In yet another embodiment, the fabric conditioning composition of the present invention comprises odor control agents. Such agents include those described in U.S. Pat. No. 5,942,217: "Uncomplexed cyclodextrin compositions for odor control", granted Aug. 24, 1999. Other agents suitable odor control agents include those described in the following: U.S. Pat. No. 5,968,404, U.S. Pat. No. 5,955,093; U.S. Pat. No. 6,106,738; U.S. Pat. No. 5,942,217; and U.S. Pat. No. 6,033,679.

8. Adjunct Components a. Thickeners and Structurants

Compositions of the present invention may contain a structurant or structuring agent. Structurants can also build viscosity to produce a useful liquid gel product form. Suitable levels of this component are in the range from about 0% to 20%, alternatively from 0.1% to 10%, and alternatively from 0.1% to 3% by weight of the laundry treatment composition. The structurant serves to stabilize the silicone polymer in the inventive compositions and to prevent it from coagulating and/or creaming. This is especially important when the inventive compositions have fluid form, as in the case of liquid or the gel-form laundry treatment compositions.

Structurants suitable for use herein include thickening stabilizers. These include gums and other similar polysaccharides, for example gellan gum, carrageenan gum, xanthan gum, Diutan gum (ex. CP Kelco) and other known types of thickeners and rheological additives such as Rheovis CDP (ex. Ciba Specialty Chemicals), Alcogum L-520 (ex. Alco Chemical), and Sepigel 305 (ex. SEPPIC). Suitable structurants are described in U.S. Patent Publ. 2006/0217288 to Wahl et al.

b. Additional Components

The laundry treatment compositions of the present invention may comprise one or more optional ingredients typically included in laundry detergent and/or softener compositions. In yet another embodiment, the composition is free or substantially free of one or more optional ingredients. Typical optional ingredients include, but are not limited to fatty acids, clays, colorants, huing dyes, brighteners, flow aids, antibacterial agents, bleach, chelants, heavy metal sequestering agents, builders, electrolytes, malodor control agents, shape retention polymers, anti-abrasion agents, dye fixatives, dye transfer inhibition agents, anti-wrinkling agents and so forth. Non-limiting examples of suitable optional ingredients are provided in U.S. Pat. No. 6,958,313 to Caswell et al. and U.S. Patent Publ. 2006/0217288.

9. Unitized Dosing

One aspect of the invention provides an article comprising a water-soluble film and a unitized dose of a laundry treatment composition in accordance with the present invention, wherein the laundry treatment composition comprises from about 1 wt. % to about 90 wt. % of an asymmetric di-hydrocarbyl quat wherein said laundry treatment composition is encapsulated by said water-soluble film.

When a unit dose of a laundry treatment composition of the present invention is added to an aqueous bath in a typical automatic washing machine basin having a volume from about 64 L to about 75 L of water, the unitized dose forms a ppm concentration which is calculated by dividing the milligrams of the active (i.e., asymmetric di-hydrocarbyl quat and/or silicone polymer) by the grams of water in aqueous bath. For example, where the laundry treatment composition is a 50 gram unit dose, said laundry treatment composition comprising 50% asymmetric di-hydrocarbyl quat, the concentration of asymmetric di-hydrocarbyl quat is about 330 ppm to about 400 ppm. In one embodiment the concentration of asymmetric di-hydrocarbyl quat is from about 10 ppm to about 1400 ppp, alternatively from about 50 ppm to about 300 ppm, alternatively from about 100 ppm to about 200 ppm.

The laundry treatment compositions of the present invention, when added to a wash solution of a laundering process, provides a concentration of at least about 1 ppm, or at least about 3 ppm, or from about 4 ppm to about 50 ppm, of coacervate in the wash solution, not including any water that may or may not be associated with the coacervate. These levels of coacervate are suitable to provide an effective level to provide a noticeable softness benefit. Higher coacervate concentrations could provide more softness, but could also possibly create cleaning and/or whiteness maintenance negatives in the laundry washing process and unnecessary cost. A typical wash solution of a laundering process has a volume of about 64 liters.

In one embodiment, the water-soluble film forms a single compartment pouch. Where the article is in the form of a single compartment pouch, the laundry treatment composition can optionally further comprise from about 1 wt. % to about 90 wt. % of an anionic surfactant.

In another embodiment, the water-soluble film forms a multi-component pouch. In one embodiment comprising a multi-compartment pouch, the multi-compartment pouch comprises a first compartment containing said laundry treatment composition comprising said asymmetric di-hydrocarbyl quat; and a second compartment containing an anionic surfactant. In another embodiment, the first compartment contains the asymmetric di-hydrocarbyl quat and anionic surfactant, while the second compartment contains a symmetric di-alkyl quaternary ammonium compound or any other conventional softener active known in the art.

a. Water-Soluble Film

In one embodiment, the laundry treatment composition is contained in a film article. The film is suitably water-soluble, i.e. made of polyvinyl alcohol, hydroxypropyl methyl cellulose, methyl cellulose, non-woven polyvinyl alcohols, PVP and gelatins or mixtures be used to encapsulate the laundry treatment compositions. Polyvinyl alcohol films are commercially available from a number of sources i.e. MonoSol LLC of Gary, Ind.; Nippon Synthetic Chemical Industry Co. Ltd. Of Osaka Japan; and Ranier Specialty Chemicals of Yakima, Wash. These films may be used in varying thicknesses ranging from about 20 to about 80 microns, or from about 25 to about 76 microns (being especially suitable for rapid dissolution in a cold water wash). Where larger volumes of composition used, i.e., volumes exceeding about 25 ml, a thicker film may be used. Further, it is suitable that the films be printable and colored.

Articles such as pouches, pillows, sachets, beads, or envelopes are manufactured by heat-sealing multiple sheets together at their edges, leaving an opening for inserting the laundry treatment composition. Examples of suitable processes for forming unit dose articles can be found in U.S. Pat. No. 6,281,183 B1, EP1126070, WO0183668, WO0183669, WO0185898, WO0183661, WO0183657, WO0183667, WO0185892, WO00208380, WO0212432, WO0220361, WO0240351, WO00183658, WO0240370, WO0160966, WO02060758, WO02060980, WO02074893, WO02057402, WO03008513, WO03008486, WO03031266, WO03045812, WO03045813, WO02060757, EP1354939, EP1375351, EP1396440, EP1431383, EP1431384, EP1340692, WO04085586, and WO 97/35537.

During the manufacture of a unit dose with a film, for example PVOH, it is useful to leave an air bubble in the pouch of a liquid composition. The air bubble is formed by slightly under filling the liquid composition into the pouch as it is being formed, for example, by vacuum. This helps prevent the liquid composition from contacting the sealing area of the film, for example when a second film is placed over the first film that is holding the liquid composition. The air bubble is from about 0.1 ml to about 10 ml in volume, alternatively from about 0.5 ml to about 5 ml. The air bubble also is a good aesthetic visual signal for the consumer that the filled pouch actually contains a liquid composition. As a visual signal, the bubble should be from about 1 mm to about 20 mm in diameter, alternatively from about 3 mm to about 10 mm.

The film article can be a single or multi-compartment pouch. A dual compartment article, for example a dual compartment unit dose made form PVOH film, can be comprised of the same or 2 different forms, for example a liquid/powder pouch, a liquid/liquid pouch, and a gel/powder pouch. In one embodiment, the article is a single compartment pouch wherein the asymmetric di-hydrocarbyl quat and anionic surfactant are both contained therein. In another embodiment, where the article is a multi-compartment pouch, the asymmetric di-hydrocarbyl quat and anionic surfactant can be in separate compartments. In yet another embodiment, the article further comprises a symmetric di-alkyl quat stored in a compartment not containing the anionic surfactant.

b. Plasticizers

For compositions intended to be enclosed or encapsulated by a film, especially a highly water-soluble film like polyvinyl alcohol, it is desirable to incorporate the same or similar plasticizers found in the film into the laundry treatment composition. This helps reduce or prevent migration of the film plasticizers into the softener composition. Loss of plasticizers from the film can cause the article to become brittle and/or lose mechanical strength over time. Typical plasticizers to include in the highly concentrated fabric softener composition are glycerin, sorbitol, 1,2 propanediol, polyethylene glycols (PEGs), and other diols and glycols and mixtures. Compositions should contain from at least about 0.1%, or at least about 1%, or at least about 5% to about 70% plasticizer or mixture of plasticizers.

c. Water Content

In one embodiment, where a water-soluble film encapsulates the laundry treatment composition, the level of water in highly concentrated laundry treatment composition is from about 0 wt. % to about 15 wt. % of water, alternatively less than about 13%, alternatively less than about 10%, alternatively less than about 5%, alternatively even about zero, alternatively from about 1 wt. % to about 15 wt. %, by weight of the composition. Generally, some water is useful, for example from about 8% to about 12% to prevent rigidity of a water soluble film. Higher water levels, however, can cause the water soluble films used to encapsulate said compositions of the present invention to leak or start to dissolve or disintegrate prematurely, either in the manufacturing process, during shipping/handling, or upon storage. It has been found that a low level of water can be desirable as medium for adding water-soluble dyes to the composition to give it an attractive color and to distinguish between compositions with different perfumes and/or added fabric care benefits, and to effectively hydrate a polymer and/or a structuring agent.

In another embodiment, the level of water in the laundry treatment composition is relatively high, for example at least about 50%, or at least about 60%, or at least about 70% water. These are generally for packaging in a single compartment plastic bottle or container, or in a dual compartment, dual pour plastic bottle or container combined with another fabric care composition, for example, a liquid detergent or bleach.

d. Solvent

Solvents are useful for fluidizing the laundry treatment compositions of the present invention, and may provide good dispersibility, and in some embodiments, provide a clear or translucent composition. Suitable solvents of the present invention can be water-soluble or water-insoluble. In one embodiment, the laundry treatment composition further comprises from about 30 wt. % to about 70 wt. % of a solvent, alternatively from about 45 wt. % to about 60 wt. %. In one embodiment, the solvent comprises a polyethylene glycol, glycerin, propylene glycol, and mixtures thereof. It is believed that where the laundry treatment composition is encapsulated in a water-soluble film, higher levels of solvent are suitable in lower water levels.

Additional non-limiting examples of solvents include ethanol, propanol, isopropanol, n-propanol, n-butanol, t-butanol, propylene glycol, 1,3-propanediol, ethylene glycol, diethylene glycol, dipropylene glycol, 1,2,3-propanetriol (glycerol), propylene carbonate, phenylethyl alcohol, 2-methyl 1,3-propanediol, hexylene glycol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), glycol ethers such as butyl carbitol and dipropylene glycol n-butyl ether, ester solvents such as dimethyl esters of adipic, glutaric, and succinic acids, hydrocarbons such as decane and dodecane, glycerine carbonate, and mixtures or combinations thereof. In one embodiment, the composition is free or substantially free of one or more of the above-identified solvents. Additional suitable solvents are disclosed in U.S. Pat. No. 6,958,313 to Caswell et al. and U.S. Patent Publ. 2006/0217288 to Wahl et al.

10. Methods of Use:

It has importantly been found that the present laundry treatment composition is suitable for softening in the wash or rinse. Without intending to be bound by theory, it is believed that unlike conventional fabric softening compositions which are typically introduced into the laundering process after the wash cycle has completed, the present laundry treatment composition provides sufficient softening, antistatic, antibacterial, and other fabric treatment benefits regardless of what cycle of the laundering process, the present invention is introduced into.

In one embodiment, the present invention provides for a method of softening a fabric through the wash process comprising: (a) dispensing into a wash bath solution a unitized dose of the laundry treatment composition comprising from about 1 wt % to about 90 wt. % of an asymmetric di-hydrocarbyl quat; and optionally, from about 1 wt. % to about 90 wt. % of an anionic surfactant composition to form a treated bath solution; and (b) contacting a fabric with said treated wash bath solution. In one embodiment, at least a portion of said asymmetric di-hydrocarbyl quat forms a coacervate when an anionic surfactant is provided from either 1) said unitized dose of the laundry treatment composition itself or 2) from the wash bath solution. Additionally, anionic surfactant can be provided from the fabric itself. In one embodiment, the method of STW further comprises forming a coacervate in-situ in the bath solution after the dispensing step of (a) or the contacting step of (b). In yet another embodiment, the laundry treatment composition used in the method of softening a fabric through the wash is in accordance with any of the embodiments disclosed herein. In one embodiment, the laundry treatment composition is added into the wash basin before the wash water is added to the basin. As wash water and any other optional laundry compositions such as detergent are added, the treated wash bath solution is formed. The detergent can be added before or after the water and/or laundry treatment composition of the present invention. Further, fabrics can be added before, after or concurrently with any of the components of the wash bath or treated wash bath solutions.

Another embodiment provides for a method of softening a fabric through the rinse comprising: (a) dispensing into a rinse bath solution a unitized dose of the laundry treatment composition comprising from about 1 wt % to about 90 wt. % of an asymmetric di-hydrocarbyl quat; wherein said laundry treatment composition is essentially free of an amido imidazoliunium compound, alternatively free or essentially free of a symmetric di-alkyl quaternary ammonium compound to form a treated rinse bath solution; and (b) contacting a fabric with the treated rinse bath solution. In one embodiment, at least a portion of said asymmetric di-hydrocarbyl quat forms a coacervate when an anionic surfactant is provided from either 1) said unitized dose of the laundry treatment composition itself or 2) as anionic carry over from the fabrics or residual wash bath solution which can stay in the wash basin when the rinse bath solution is formed. In one embodiment, the laundry treatment composition is added into the rinse basin before the rinse water is added to the basin. As rinse water and any other optional laundry compositions, such as perfumes or other optional conventional rinse additives, are added, the treated rinse bath solution is formed.

EXAMPLES

Examples I-IV

Single Compartment Liquid Unit Dose Pouch, About 10 Grams in Weight PVOH Film Used is Monosol M8630 at 3 mil Thickness

| Ingredient | Example I: Wt. % | Example II: Wt. % | Example III: Wt. % |
|---|---|---|---|
| Arquad HTL8-MS | 40.0 | 40.0 | 50.0 |
| Branched Anionic Surfactant (Neodol 23-9) | 2.4 | 2.4 | 2.0 |
| Alcohol Ethoxylate 1.8S | 1.3 | 1.3 | 0 |
| Glycerin | 15.0 | 15.0 | 10 |
| PEG400 | 23.5 | 25 | 2.0 |
| Perfume | 5.3 | 2.5 | 5 |
| Perfume Microcapsules | 0 | 1.0 | 0 |
| Dye | 0.2 | 0.2 | 0.2 |
| HCl | 0.8 | 0.8 | 0.8 |
| Water | 11.5 | 11.8 | 10.0 |
| Solvent (Glycerine Carbonate) | 0 | 0 | 20 |

| Ingredient | Example IV: Wt. % |
|---|---|
| Arquad HTL8-MS | 10.0 |
| Linear alkylbenzene sulfonic acid | 5.0 |
| Alkyl ethoxylates | 50.8 |
| Alkylamidopropyl amine | 3.3 |
| Citric acid | 3.2 |
| Chelant (DTPA) | 0.3 |
| Amine ethoxylate polymers | 3.7 |
| 1,2-propanediol | 9.0 |
| Monoethanolamine | to pH 8.0 |
| Enzyme (Protease) | 1.8 |
| Enzyme (Amylase) | 0.4 |
| Enzyme (Lipase) | 0.1 |
| Formic acid | 1.0 |
| Calcium and sodium formate | 0.5 |
| Fluorescent whitening agent | 0.25 |
| Dye | 0.002 |
| Perfume | 5.0 |
| Water | Balance |

Example V

Dual Compartment Liquid Unit Dose Pouch

| Ingredient | Example V: Wt. % |
|---|---|
| First compartment - 10 grams | |
| Arquad HTL8-MS | 40.0 |
| Neodol 23-9 | 2.4 |
| Glycerin | 15.0 |
| PEG400 | 24.8 |
| Perfume | 5.3 |
| Dye | 0.2 |
| HCl | 0.8 |
| Water | 11.5 |
| Second compartment - 50 grams | |
| Linear alkylbenzene sulfonic acid | 5.0 |
| Alkyl ethoxylates | 50.8 |
| Alkylamidopropyl amine | 3.3 |
| Citric acid | 3.2 |
| Chelant (DTPA) | 0.3 |
| Amine ethoxylate polymers | 3.7 |
| 1,2-propanediol | 17.5 |
| Monoethanolamine | to pH 8.0 |
| Enzymes | 2.3 |
| Formic acid | 1.0 |
| Calcium and sodium formate | 0.5 |
| Fluorescent whitening agent | 0.25 |
| Dye | 0.002 |
| Water | Balance |

Example VI

Two Compartment Powder/Liquid Unit Dose Pouch

| Ingredient | Example VI: Wt. % |
|---|---|
| First compartment - 10 grams | |
| Arquad HTL8-MS | 45.0 |
| Glycerin | 15.0 |
| PEG400 | 24.5 |
| Perfume | 3.0 |
| Dye | 0.2 |
| HCl | 0.8 |
| Water | 11.5 |
| Second compartment - 50 grams | |
| Tide Free Powder detergent | 99.0 |
| Perfume Microcapsules | 1.0 |

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Except as otherwise noted, the articles "a," "an," and "the" mean "one or more."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry treatment composition comprising:

a. from about 1 wt. % to about 90 wt. % of an asymmetric di-hydrocarbyl quaternary ammonium compound comprising the structure:

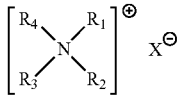

wherein $R_1$ comprises a $C_{12}$ to $C_{22}$ hydrocarbyl chain,
wherein $R_2$ comprises a $C_6$ to $C_{12}$ hydrocarbyl chain,
wherein $R_1$ has at least two more carbon atoms in the hydrocarbyl chain than $R_2$,
wherein $R_3$ and $R_4$ are individually selected from the group consisting of $C_1$-$C_4$ hydrocarbyl, $C_1$-$C_4$ hydroxy hydrocarbyl, benzyl, —$(C_2H_4O)_xH$ where x has a value from about 1 to about 10, and mixtures thereof, and
wherein $X^-$ is a anion; and b. from about 1 wt. % to about 90 wt. % of an anionic surfactant, wherein at least a portion of said asymmetric di-hydrocarbyl quaternary ammonium compound and said anionic surfactant form a coacervate; and c. from about 2 wt. % to about 30 wt. % of a silicone polymer.

2. The laundry treatment composition according to claim 1, wherein said launder treatment composition is essentially free of an amido imidazolinium compound.

3. The laundry treatment composition according to claim 1, wherein $R_3$ and $R_4$ are individually selected from the group consisting of a $C_1$-$C_4$ hydrocarbyl chain and a $C_1$-$C_4$ hydroxy hydrocarbyl chain.

4. The laundry treatment composition according to claim 1, wherein said $R_2$ comprises a branched hydrocarbyl radical having from about 8 to about 12 carbon atoms.

5. The laundry treatment composition according to claim 4, wherein said asymmetric di-hydrocarbyl quaternary ammonium compound consists essentially of a hydrogenated tallow 2-ethyl-hexyl-ammonium compound.

6. The laundry treatment composition according to claim 1, wherein said asymmetric di-hydrocarbyl quaternary ammonium compound has a ClogP of from about 4 to about 9.

7. The laundry treatment composition according to claim 1, further comprising from about 0.1 wt. % to about 20 wt. % of a deposition aid.

8. The laundry treatment composition according to claim 1, further comprising a weight ratio of said asymmetric di-hydrocarbyl quaternary ammonium compound to said anionic surfactant of from about 20:1 to about 1:5.

9. The laundry treatment composition according to claim 1, wherein said anionic surfactant comprises: a $C_{11}$-$C_{18}$ alkyl benzene sulfonate surfactant; a $C_{10}$-$C_{20}$ branched-chain and random alkyl sulfate surfactant; a $C_{10}$-$C_{18}$ alkyl alkoxy sulfate surfactant, having an average degree of alkoxylation of from 1 to 30, wherein the alkoxy comprises a $C_1$ to $C_4$ chain and mixtures thereof; a mid-chain branched alkyl sulfate surfactant; a mid-chain branched alkyl alkoxy sulfate surfactant having an average degree of alkoxylation of from 1 to 30, wherein the alkoxy comprises a $C_1$ to $C_4$ chain and mixtures thereof; a $C_{10}$-$C_{18}$ alkyl alkoxy carboxylates comprising an average degree of alkoxylation of from 1 to 5; a $C_{12}$-$C_{20}$ methyl ester sulfonate surfactant, a $C_{10}$-$C_{18}$ alpha-olefin sulfonate surfactant, a $C_6$-$C_{20}$ sulfosuccinate surfactant, and a mixture thereof.

10. The laundry treatment composition according to claim 1, further comprising from about 0.5 wt. % to about 95 wt. % of a perfume, said perfume comprising: a perfume oil, at least one perfume microcapsule, and mixtures thereof.

11. A laundry treatment article comprising:

a. a water-soluble film optionally comprising a polyvinyl alcohol;

b. from about 0.05 grams to about 100 grams of a laundry treatment composition comprising:

from about 1 wt. % to about 90 wt. % of an asymmetric di-hydrocarbyl quaternary ammonium compound comprising the structure:

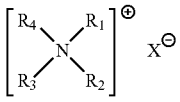

wherein $R_1$ comprises a $C_{12}$ to $C_{22}$ hydrocarbyl chain, wherein $R_2$ comprises a $C_6$ to $C_{12}$ hydrocarbyl chain, wherein $R_1$ has at least two more carbon atoms in the hydrocarbyl chain than $R_2$, wherein $R_3$ and $R_4$ are individually selected from the group consisting of $C_1$-$C_4$ hydrocarbyl, $C_1$-$C_4$ hydroxy hydrocarbyl, benzyl, —$(C_2H_4O)_xH$ where x has a value from about 1 to about 10, and mixtures thereof, and wherein $X^-$ is a anion, wherein said laundry treatment composition is encapsulated by said water-soluble film.

12. The laundry treatment article according to claim 11, wherein said water-soluble film forms a single compartment pouch and wherein said laundry treatment composition further comprises from about 1 wt. % to about 90 wt. % of an anionic surfactant, wherein at least a portion of said asymmetric di-hydrocarbyl quaternary ammonium compound and said anionic surfactant form a coacervate.

13. The laundry treatment article according to claim 11, wherein said water-soluble film forms a multi-component pouch, wherein said multi-compartment pouch comprises a first compartment containing said laundry treatment composition; and a second compartment containing an anionic surfactant.

14. The laundry treatment article according to claim 11, wherein said laundry treatment composition further comprises from about 0 wt. % to about 15 wt. % of water.

15. The laundry treatment article according to claim 14, wherein said laundry treatment composition further comprises from about 30 wt. % to about 70 wt. % of a solvent, said solvent comprising a polyethylene glycol, glycerin, propylene glycol, and mixtures thereof; from about 2 wt. % to about 30 wt. % of a silicone polymer, from about 0.1 wt. % to about 20 wt. % of a deposition aid; a perfume microcapsule; and from about 8 wt. % to about 50 wt. % of said asymmetric di-hydrocarbyl quaternary ammonium compound, wherein said asymmetric di-hydrocarbyl quaternary ammonium compound is a hydrogenated tallow 2-ethyl-hexyl-ammonium compound.

* * * * *